United States Patent [19]

Watts et al.

[11] 3,984,260

[45] Oct. 5, 1976

[54] ALUMINIUM BASE ALLOYS

[75] Inventors: Brian Michael Watts, Haverhill; Edward Frederick Emley, Chalfont St. Gilles; Michael James Stowell, Saffron Walden, all of England

[73] Assignees: British Aluminum Company, Limited, London; T. I. (Group Services) Limited, Birmingham, both of England

[22] Filed: Sept. 26, 1974

[21] Appl. No.: 509,406

Related U.S. Application Data

[62] Division of Ser. No. 273,639, July 20, 1972, Pat. No. 3,876,474.

[30] Foreign Application Priority Data

July 20, 1971 United Kingdom ..... 33922/71
June 27, 1972 United Kingdom ..... 33922/72

[52] U.S. Cl. ..... 148/32; 29/527.7; 75/138; 148/2; 148/11.5 A

[51] Int. Cl.[2] ..... C22C 21/00

[58] Field of Search ..... 148/2, 11.5 A, 32, 32.5; 75/138–148; 29/527.7

[56] References Cited

UNITED STATES PATENTS 2,245,167 6/1941 Stroup ..... 148/11.5 A

*Primary Examiner*—R. Dean
*Attorney, Agent, or Firm*—Karl W. Flocks

[57] ABSTRACT

Aluminum-base wrought products containing the elements normally present in either non-heat treatable aluminium-base alloys of at least 5%Mg or at least 1%Zn or heat-treatable aluminium-base alloys of one or more of the elements Cu, Mg, Zn, Si, Li and Mn in known combinations, and at least one of the elements Zr, Nb, Ta and Ni in a total amount of at least 0.30% substantially all of which is present in solid solution, are superplastically deformable. The remainder of the superplastically deformable product may be the normal impurities and incidental elements known to be incorporated in heat-treatable and non-heat treatable aluminium-base alloys. Advantageously the alloy of the wrought product contains at least 0.3%Zr and preferably at least 0.40%Zr. The wrought product disclosed may in some cases be deformed superplastically under isothermal conditions but it has been found advantageous to heat the alloy quickly to the superplastic forming temperature and/or allow the temperature to rise whilst the deformaton is in progress.

26 Claims, No Drawings

ALUMINIUM BASE ALLOYS

This is a division of application Ser. No. 273,639, filed July 20, 1972, now U.S. Pat. No. 3,876,474.

BACKGROUND OF THE INVENTION

It is known that certain alloys under certain conditions can undergo very large amounts of deformation without failure, the phenomenon being known as superplasticity and characterised by a high strain rate sensitivity index in the material as a result of which the normal tendency of a stretched specimen to undergo preferential local deformation ("necking") is suppressed. Such large deformations are moreover possible at relatively low stresses so that the forming or shaping of superplastic alloys can be performed more simply and cheaply than is possible with even highly ductile materials which do not exhibit the phenomenon. As a convenient numerical criterion of the presence of superplasticity, it may be taken that a superplastic material will show a strain rate sensitivity ("m"-value) of at least 0.3 and a uniaxial tensile elongation at temperature of at least 200%, "m"-value being defined by the relationship $\sigma = \eta\ \dot{\epsilon}^m$ where $\sigma$ represents flow stress, $\eta$ a constant, $\dot{\epsilon}$ strain rate and m strain rate sensitivity index.

No known aluminium-base alloy can be superplastically deformed other than the Al-Cu entectic composition which contains 33% copper and has neither the low density nor the good corrosion resistance characteristic of aluminium alloys. A known alloy of 22% Al and 78% Zn is also superplastically deformable, but because of its high density and poor creep and corrosion resistance has not found commercial acceptance.

SUMMARY OF THE INVENTION

According to one aspect of the present invention a superplastically deformable aluminium-base alloy consists of an aluminium-base wrought product of non-heat treatable aluminium-base alloys containing at least 5%Mg or at least 1%Zn and heat treatable aluminium-base alloys containing one or more of the elements Cu, Mg, Zn, Si, Li and Mn in known combinations and quantities, and at least one of the elements Zr, Nb, Ta and Ni in a total amount of at least 0.30% substantially all of which is present in solid solution, the remainder being normal impurities and incidental elements known to be incorporated in the said aluminium-base alloys.

According to another aspect of the present invention a method of making such a superplastically deformable aluminium-base semi-fabricated product comprises casting a liquid alloy having a composition according to the immediately preceding paragraph at a temperature of at least 775°C to produce a cell size in the cast alloy not exceeding 30 $\mu$M and subjecting the cast alloy to plastic working at a temperature not substantially in excess of 550°C.

By cell size is meant secondary dendrite arm spacing.

The invention also extends to an article shaped by the plastic forming of an alloy according to the said one aspect of the invention.

DESCRIPTION OF THE PREFERRED EMBODIMENTS

Throughout this specification all percentages of elements are given as percentages by weight.

By "heat-treatable alloys" is meant those classes of alloys in which the mechanical properties can be improved by precipitation hardening treatments, for example alloys of the Al-Cu, Al-Cu-Mg, Al-Mg-Si and Al-Zn-Mg systems.

By "non-heat-treatable alloys" is meant those classes of alloys in which the mechanical properties cannot be significantly improved by precipitation hardening treatments, for example alloys of the Al-Mn, Al-Mg and Al-Zn systems.

Of the elements Zr, Nb, Ta and Ni it is preferred to use zirconium (Zr) in the alloy according to the invention as niobium (Nb), tantalum (Ta) and nickel (Ni) have been found to be less effective than zirconium in inducing superplastic behaviour in the alloy. These four elements have low solubility, high temperature coefficient of solubility and diffuse only very slowly in aluminium even at temperatures as high as 500°C. When zirconium only is used in the alloy it is used in a quantity of at least 0.30% and preferably of at least 0.40%.

It is believed that the alloys according to the invention owe their superplastic properties to the presence of a supersaturated solid solution of one or more of the elements Zr, Nb, Ta and Ni in a sufficient quantity physically to restrict aluminium grain growth by giving rise at the temperatures employed for hot forming to a fine sub-optical precipitate capable of restricting grain boundary movements. The formation of such a fine sub-optical precipitate has been verified in alloys containing each of the elements Zr, Nb, Ta or Ni, but it was not found with Cr. or Mn.

Zirconium is already known to confer on certain aluminium-base alloys both grain refinement of the cast alloys and to restrict grain coarsening of the worked alloys. However, the maximum liquid solubility of zirconium in aluminium at the peritectic temperature is approximately 0.11% and additions of zirconium to aluminium alloys do not normally exceed 0.20%.

Tests carried out on alloys formed from pure grades of aluminium with 0.2% and 0.5% zirconium additions did not result in superplastic behaviour at any temperature of testing in the range 350°C to 500°C. Tests have shown that an aluminium-manganese alloy also does not deform superplastically after the addition of zirconium. These tests indicated that for an aluminium-base alloy to be superplastically deformable it is necessary not only to provide a slow diffusing element such as zirconium which would precipitate in the form of finely dispersed and relatively stable second phase particles from a supersaturated solution during hot forming, but also to provide one or more additional elements which inhibit recovery processes and allow the alloy to crystallise to an ultra fine grain structure, for example by lowering the high stacking fault energy of aluminium, thereby making possible the occurrence of dynamic recrystallisation during or prior to the hot forming.

These additional elements include Cu, Mg, Zn, Li and Si in such combinations and in such quantities as are commonly used in heat treatable aluminium alloys and Mg and Cu in such combinations and quantities as may be used to produce non-heat treatable alloys of Al-Mg or Al-Zn systems containing at least 5% Mg or at least 1% Zn respectively.

Particular suitable combinations of additional elements include.

--- a. Cu 1.75 to 10 %

-continued

| | | | | | | |
|---|---|---|---|---|---|---|
| | Mg | 0 | to | 2 | % | |
| | Si | 0 | to | 1.5 | % | |
| b. | Cu | 2.5 | to | 7 | % | |
| | Mg | 0 | to | 0.5 | % | |
| c. | Cu | 3.5 | to | 5.5 | % | |
| | Mg | 0.25 | to | 1.25 | % | |
| | Si | 0.25 | to | 1 | % | |
| | Mn | 0.25 | to | 1 | % | |
| d. | Zn | 2 | to | 8 | % | |
| | Mg | 0.75 | to | 4 | % | |
| | Cu | 0 | to | 2 | % | |
| e. | Zn | 3 | to | 5.5 | % | |
| | Mg | 1 | to | 2 | % | |
| | Cu | 0 | to | 0.3 | % | |
| f. | Zn | 4 | to | 7.5 | % | |
| | Mg | 2 | to | 3 | % | |
| | Cu | 1 | to | 2 | % | |
| g. | Si | 0.4 | to | 0.9 | % | |
| | Mg | 0.5 | to | 1 | % | |
| h. | Zn | 1 | to | 15 | %, | preferably 2 – 12% |
| | Mg | 0 | to | 0.5 | % | |
| | Cu | 0 | to | 0.5 | % | |
| i. | Mg | 5 | to | 10 | %, | preferably at least 6% |
| | Cu | 0 | to | 0.5 | % | |

It will be appreciated from what has previously been stated that the additional elements of either *h* or *i* when alloyed with aluminium give a non-heat treatable alloy while the additional elements of any one of the remaining combinations when alloyed with aluminium give a heat-treatable alloy. Alloys containing the additional elements *h* may need a higher forming temperature range for best results e.g. up to 550°C.

It is to be understood that the alloy according to the invention may contain the impurities normally to be found in heat treatable and non-heat-treatable aluminium-base alloys and one or more of the incidental elements known to be added to such aluminium-base alloys. These incidental elements include in percentages by weight:

Ti 0 to 0.2
B 0 to 0.05
Be 0 to 0.01
Cr 0 to 0.2
Ge 0 to 0.5
Cd 0 to 0.25
Ag 0 to 0.6
Pb 0 to 0.6
Bi 0 to 0.6
Rare earth metals 0 to 0.25
and Mn 0 to 0.4 when not present as a specified constituent.

The total amount of the alloying elements of combinations *a* to *i* preferably will not exceed 10%. Small quantities of incidental elements such as Ti, Cr and Mn may be included in the quantities previously listed to control cast structure or suppress recrystallisation during final heat treatment, the total quantity of these optional incidental elements, excluding Pb and Bi, not exceeding 0.75%. To improve the machinability of the alloys small additions of Pb and/or Bi may be made in quantities up to 0.6% of each and up to 1% in total. When Pb and/or Bi are present in the alloy, the total quantity of incidental elements, including Pb and/or Bi, will not exceed 1.25%.

The alloys according to the invention may in some cases be deformed superplastically under isothermal conditions following prolonged soaking at superplastic forming temperature but it has been found advantageous to heat the alloy quickly to the superplastic forming temperature and/or allow the temperature to rise whilst the deformation is in progress. Under the latter conditions elongation values of 800% to 1200% were obtained on Al-6%Cu-0.5%Zr alloys which had previously shown elongation values of 500% to 700% after soaking at the plastic forming temperature and isothermal deformation. The following table illustrates the differences in the results obtained by the two forming techniques on four other alloy compositions together with isothermal data on two further compositions.

TABLE A

| Alloy Type | Approx. Composition* | Elongation % at forming temperature: Isothermal test after soaking at temperature | Elongation % at forming temperature: Rapid heating and/or rising temperature during test |
|---|---|---|---|
| BA 733 | Al; 4.5%Zn; 0.8Mg | 150 | 330 |
| BS L88 | Al; 6%Zn; 3%Mg; 1.5%Cu | 540 | — |
| BS 2L70 | Al; 5%Cu; 0.9%Si; 0.8%Mu; 0.4%Mg | 170 | 300 |
| AA 2219 | Al; 6.5%Cu; 0.3%Mn; 0.1%V | 140 | 540 |
| BS M20 | Al; 0.7%Mg; 0.6%Si; 0.25%Cu | 200 | 288 |
| BS M20 | Al; 7%Mg | 250 | — |
| — | Al; 10%Zn | 600 | — |
| — | Al; 3%Zn | 360 | — |

*Exclusive of zirconium at approximately 0.5% level except for the Al; 7%Mg alloy where 0.8% zirconium was present.

All the alloys were rapidly cast from temperatures in the excess of 850°C.

Attempts to determine the dissolved zirconium content in alloys according to the invention by wet chemical processes have not yet proved entirely satisfactory, but a suitable content can be assured by casting from much higher temperatures than are usual in the production of aluminium semi-fabricated wrought products together with the use of more rapid solidification of the liquid alloy. Thus, whilst casting temperatures for known aluminium wrought alloys are in the range 665°C to 725°C, the alloy of the present invention is cast at temperatures in the range 775°C to 925°C and preferably above 800°C. For best results a casting temperature in the range 825°C to 900°C is preferred. Similarly, whilst the normal solidification rates obtaining in semi-continuous direct chill casting result in an average cell size or secondary dendrite arm spacing of 40 to 70 $\mu$M, the solidification rates of the alloys according to the invention are designed to be such that the average cell size does not exceed 30 $\mu$M, and preferably does not exceed 25 $\mu$M. In this way the minimum dissolved zirconium content required, believed to be 0.25% represents 0.2% in excess of the equilibrium solubility of zirconium at 500°C.

If desired the approximate proportion of dissolved zirconium in an alloy of known total zirconium content can be determined by microprobe analysis; alternatively optical microscopy can be used to provide a rapid check as to whether or not there is a substantial proportion of the zirconium not in solution, the phase $ZrAl_3$ being easily recognisable.

When the alloy contains Nb or Ta in place of Zr, a high casting temperature and fine cell size are required; with Ni in place of Zr a high casting temperature is not essential.

To assist in the maintenance of a high level of supersaturated zirconium, the alloys of the present invention may be prepared by splat cooling or spray casting in known manner or by compacting blown powder.

To illustrate the invention aluminium-base alloys containing copper as an essential alloying element, but containing other optional alloying elements as will be mentioned, are now described by way of example.

Ordinary commercial aluminium of minimum purity 99.5% may be used for preparing the alloy but better results are obtained by limiting the iron and silicon content, e.g. by preparing the alloy from high purity aluminium of about 99.85% purity. Metal with purity lower than 99.5% (e.g. 99.3%) has nevertheless given acceptable results.

At a given purity level the adverse effects of iron and silicon are minimised if these elements are present in approximately equal atomic proportions. Thus as good results are obtained from 99.8% aluminium with atomically balanced iron and silicon as from 99.9% aluminium with an Fe:Si atomic ratio of 1:2 or 2:1. A 1:1 atomic ratio corresponds almost exactly to an Fe:Si ratio of 2:1 by weight, the Fe:Si will therefore desirably lie between 1.5:1 and 2.5:1 by weight.

Preferably the copper content is in the range 2.5% to 7% and particularly in the range 3.5% to 6.5%. For high tensile properties in the formed or shaped object after subsequent full heat treatment, combined with good rolling properties, a copper content of 5.75% to 6.25% may be used. A substantially higher copper content than 7% can be tolerated where the alloy is to be extruded rather than rolled or can be pre-extruded prior to rolling, for example up to 10%.

Small amounts of some elements may be tolerated or added with a view to conferring certain properties on the resulting alloy. Magnesium may be added in amounts up to about 0.5%; manganese and cadmium may each be added in amounts preferably not exceeding 0.25%, whilst small amounts ranging from 0 to 0.2% of one or more grain refining elements Ti, Ta and Sc may be added to assist in obtaining a fine grained cast structure. Germanium may also be added in quantities up to 0.5% to control ageing behaviour.

To achieve superplasticity it appears to be necessary for the alloy when cast to contain a minimum level of zirconium in supersaturated solid solution so that the zirconium is then available to precipitate in such a manner during the hot forming operation as will assist in the production or maintenance of a very fine grained structure of average grain size below 15 $\mu$M similar to that observed in other superplastic materials. This minimum content of dissolved zirconium will not be achieved unless the total zirconium content of the metal is at least 0.30%, and preferably at least 0.40%.

To obtain superplastic behaviour the copper content should desirably exceed the solid solubility level at the hot forming temperature. Thus for forming at a temperature of 400°–425°C the minimum copper content is desirably about 2%.

Hot forming will generally be carried out in the temperature range 300°–500°C and preferentially in the range 350°–475°C.

Although the slow diffusion rate of zirconium in aluminium allows the cast alloy to be hot worked by rolling or extrusion to a considerable degree without excessive pecipitation from the alloy of the zirconium in excess of saturation (it being on the presence of excess zirconium that the capability for subsequent superplastic forming depends) it is clearly desirable to avoid excessive pre-heating of the alloy prior to hot working and to carry out the working operations at temperatures below those at which the precipitation of zirconium is rapid, e.g. in the range 300°C to 500°C. If desired the cast metal may be held for some time at temperatures in the range 300°C to 400°C prior to hot working without detriment and sometimes with benefit to the final superplastic forming properties.

The hot formed objects may be heat treated to develop maximum tensile properties, e.g. the components may be solution heat treated for 40 min at 535°C, rapidly cooled and then artificially aged (precipitation heat treated) for 6 hr at 170°C. Alternatively, though at some sacrifice in their final properties, the objects may be rapidly cooled after hot forming and then artificially aged.

The alloys are fusion weldable provided they have a magnesium content not materially exceeding about 0.25%.

If prepared using high purity aluminium the alloys may be chemically brightened and anodised or subjected to other forms of decorative anodising treatment. For bright anodising the copper content may usefully be about 2.5%, and the combined content of iron and silicon should not exceed 0.2%. Alternatively, the alloys may be clad, e.g. with pure aluminium, to improve their corrosion resistance.

By virtue of their superplastic behaviour the alloys may be formed into complex shapes with sharp angles by applying air pressure for a few minutes to the alloy heated to a temperature in the range 300°C to 500°C.

Reference is now made to the following more specific Examples and experiments.

EXAMPLE 1

To show the effect of zirconium on the superplastic properties of Al-6%Cu-Zr alloys, melts were made with varying zirconium content as shown in Table B and cast into slab moulds. The cast alloy was then rolled at approximately 300°C, soaked at 450°C and strained at this temperature to simulate a forming process. Flow stress values were measured at various strain rates in the range $6.7 \times 10^{-5}sec^{-1}$ to $2.3 \times 10^{-2}sec^{-1}$ in order to determine *m* values after which the specimen was strained at 0.1 in/min to fracture. The results obtained are given in Table B.

TABLE B

| Total Zr content (wt%) | Maximum m-value | % elongation |
|---|---|---|
| Nil | 0.21 | 127 |
| 0.20 | 0.13 | 88 |
| 0.26 | 0.26 | 154 |
| 0.33 | 0.40 | 438 |
| 0.42 | 0.38 | 612 |
| 0.52 | 0.42 | 315 |
| Criteria for superplastic behaviour | 0.30 min | 200 min |

It will be seen from Table B that for superplastic behaviour a minimum total zirconium content of about 0.3% is required.

EXAMPLE II

In a series of bulge test experiments some 0.030in thick sheets having the composition Al-6%Cu-0.4%Zr were submitted to bulge tests at 440°C and 455°C. The sheet was blown by air pressure through an open circular die so as to form an unsupported bulge as shown by the results in Table C.

TABLE C

| Forming temp (°C) | Pressure applied (p.s.i.) | Height/dia ratio of bulge | Time taken (min) |
|---|---|---|---|
| 440 | 72.5 | 0.515 | 7.3 |
| 455 | 72.5 | 0.515 | 3.7 |

In other experiments sheets of alloy, in accordance with the present invention, were superplastically formed into complex sharp-cornered shapes by using air pressure to force the sheet into a female die of the desired shape. With large components the air pressure required is less; for example recessed components of approximately 2sq.ft. of projected area were blown with pressures as low as 20 p.s.i.

EXAMPLE III

In other experiments an alloy of the composition Al-6%Cu - 0.5%Zr was rolled and subjected to 200% isothermal deformation at 400°C at a velocity of 0.05 in/min. Tensile tests were carried out on specimens taken from the deformed alloy and also after full heat treatment on the deformed alloy with the results shown in Table D.

TABLE D

| Condition | Tensile properties at room temperature | | | |
|---|---|---|---|---|
| | 0.1% proof stress MNm-2 (tsI) | U.T.S. MNm-2 (tsI) | % elong (on 50 mm g.l.) | Hardness HV |
| As deformed | 99 (6.4) | 190 (12.3) | 16 | 62 |
| Fully heat treated 40 min at 535°C water quench 6 hrs at 170°C | 304 (19.7) | 437 (28.3) | 12 | 140 |

It will be seen therefore that an alloy of the present invention is capable of being superplastically deformed and subsequently heat treated to give very attractive tensile properties. By modification of the ageing cycle even higher tensile properties can be obtained at some sacrifice of elongation. The alloy moreover has high resistance to both creep and fatigue.

A further advantage of the Al-Cu alloys at present being discussed is that the superplastic behaviour is not limited to a narrow range of temperature. Typical results from two casts of alloy are shown in Table E.

TABLE E

| Cast No. | Composition | Forming temp °C | Maximum m-value | % elong |
|---|---|---|---|---|
| 1 | Al-6%Cu-0.52%Zr | 400 | 0.45 | 210 |
| | | 425 | 0.45 | 300 |
| | | 450 | 0.42 | 320 |
| 2 | Al-6%Cu-0.50%Zr | 400 | 0.41 | 410 |
| | | 425 | 0.41 | 300 |
| | | 450 | 0.40 | 250 |

The effect of additions of titanium or chromium in place of zirconium to an Al-6% Cu alloy have been investigated, but even with many tenths per cent of Cr and/or Ti present it was only possible to induce at most a marginal degree of superplasticity in the rolled metal. It appears therefore that an additive which will grain refine the cast structure or which will hinder grain growth after hot working is not sufficient and that performance of both functions by two additives is not sufficient for superplasticity to be developed in the absence of the fine sub-optical precipitate of the kind produced with Zr, Nb, Ta and Ni but not by Cr and Mn.

We claim:

1. A superplastic aluminium-base wrought product of very fine grained structure of average grain size below 15 $\mu$M, formed of 1. an aluminium-base alloy selected from the group consisting of
   - 1-a. non-heat-treatable aluminium-base alloys of aluminium and one of the elements selected from the group consisting of Mg and Zn, the quantity of Mg being from 5% to 10% with 0 to 0.5% Cu, and the quantity of Zn being from 1% to 15% with 0 to 0.5% Mg and 0 to 0.5% Cu, and
   - 1-b. heat-treatable aluminium-base alloys of aluminium and one of the elements selected from the group consisting of Cu, Mg, Zn, Si, Li, Mn and mixtures thereof in known combinations and quantities in a total quantity not exceeding 10%, and
2. Zr in an amount of 0.3% to 0.8% in total content of which at least 0.25% is present in solid solution,
3. the remainder of said superplastically deformable alloy being normal impurities and incidental elements known to be incorporated in said aluminium-base alloys.

2. A superplastic aluminium-base wrought product according to claim 1, wherein said (1-b) heat-treatable aluminium-base alloy consists essentially of aluminium and

| | | | |
|---|---|---|---|
| Cu. | 2.5 | to | 7 |
| Mg | 0 | to | 0.5 |

in percentages by weight based on the total composition.

3. A superplastic aluminium-base wrought product according to claim 1, wherein said (1-b) heat-treatable aluminium-base alloy consists essentially of aluminium and

| | | | |
|---|---|---|---|
| Zn | 2 | to | 8 |
| Mg | 0.75 | to | 4 |
| Cu | 0 | to | 2 |

in percentages by weight based on the total composition.

4. A superplastic aluminium-base wrought product according to claim 1, wherein said (1-b) heat-treatable aluminium-base alloy consists essentially of aluminium and

| | | | |
|---|---|---|---|
| Zn | 3 | to | 5.5 |
| Mg | 1 | to | 2 |
| Cu | 0 | to | 0.3 |

in percentages by weight based on the total composition.

5. A superplastic aluminium-base wrought product according to claim 1, wherein said (1-a) non-heat-treatable aluminium-base alloy consists essentially of aluminium and

| | | |
|---|---|---|
| Zn | 1 | to 15 |
| Mg | 0 | to 0.5 |
| Cu | 0 | to 0.5 |

in percentages by weight based on the total composition.

6. A superplastic aluminium-base wrought product according to claim 1 wherein said (1-a) non-heat-treatable aluminium-base alloy consists essentially of aluminium and

| | | |
|---|---|---|
| Mg | 5 | to 10 |
| Cu | 0 | to 0.5 |

in percentages by weight based on the total composition.

7. A method of making a superplastically deformable aluminium-base alloy semi-fabricated product comprising casting a liquid alloy having a composition of 1. an aluminium-base alloy selected from the group consisting of
   1-a. non-heat treatable aluminium-base alloys of aluminium and one of the elements selected from the group consisting of Mg and Zn, the quantity of Mg being from 5% to 10% with 0 to 0.5% Cu, and the quantity of Zn being from 1% to 15% with 0 to 0.5% Mg and 0 to 0.5% Cu, and
   1-b. heat-treatable aluminium-base alloys of aluminium and one of the elements selected from the group consisting of Cu, Mg, Zn, Si, Li, Mn and mixtures thereof in known combinations and quantities in a total quantity not exceeding 10%, and
2. Zr in an amount of 0.3% to 0.8% in total content of which at least 0.25% is present in solid solution,
3. the remainder of said superplastically deformable alloy being normal impurities and incidental elements known to be incorporated in said aluminium-base alloys, at a temperature of at least 775°C to produce a cell size in the case alloy not exceeding 30 $\mu$M and subjecting the cast alloy to plastic working at a temperature not substantially in excess of 550°C.

8. A method according to claim 7, in which the alloy is cast at a temperature of from 775°C to 925°C.

9. A method according to claim 8, in which the alloy is cast at a temperature in excess of 800°C.

10. A method according to claim 8, in which the alloy is cast at a temperature ranging from 825°C to 900°C.

11. A method according to claim 7, in which the cast product is subjected to plastic deformation at a temperature ranging from 300°C to 500°C.

12. A method according to claim 11, in which the cast product is subjected to plastic working at a temperature ranging from 350°C to 475°C.

13. An article shaped by the plastic forming of the wrought product of claim 1.

14. An article in accordance with claim 13, and having a microstructure consisting of equiaxed grains with an average diameter less than 15 $\mu$M.

15. An article as claimed in claim 13, and having a 0.2% proof stress value of at least fifteen tons per square inch and an ultimate tensile stress of at least 20 tons per square inch.

16. An article shaped by the plastic forming of a wrought product as claimed in claim 2, and containing iron and silicon as normal impurities in quantities such that their total content does not exceed 0.20%, the article having been subjected to a surface brightening treatment.

17. An article shaped by the plastic forming of a wrought product as claimed in claim 3, and containing iron and silicon as normal impurities in quantities such that their total content does not exceed 0.20%, the article having been subjected to a surface brightening treatment.

18. An article shaped by the plastic forming of a wrought product as claimed in claim 4, and containing iron and silicon as normal impurities in quantities such that their total content does not exceed 0.20%, the article having been subjected to a surface brightening treatment.

19. An article shaped by the plastic forming of a wrought product as claimed in claim 5, and containing iron and silicon as normal impurities in quantities such that their total content does not exceed 0.20%, the article having been subjected to a surface brightening treatment.

20. An article shaped by the plastic forming of a wrought product as claimed in claim 6, and containing iron and silicon as normal impurities in quantities such that their total content does not exceed 0.20%, the article having been subjected to a surface brightening treatment.

21. A wrought product according to claim 1, having been cast at a temperature of at least 775°C to produce a cell size in the cast alloy not exceeding 30 $\mu$M and having been subsequently subjected to plastic working at a temperature not substantially in excess of 550°C.

22. A wrought product according to claim 21 having been cast at a temperature of from 775°C to 925°C.

23. A wrought product according to claim 22 having been cast at a temperature in excess of 800°C.

24. A wrought product according to claim 22, having been cast at a temperature from 825°C to 900°C.

25. A wrought product according to claim 21, having been subjected to plastic deformation at a temperature ranging from 300°C to 500°C.

26. A wrought product according to claim 25, having been subjected to plastic working at a temperature ranging from 350°C to 475°C.

* * * * *